US008276347B2

(12) United States Patent
Ours et al.

(10) Patent No.: US 8,276,347 B2
(45) Date of Patent: Oct. 2, 2012

(54) METHOD FOR FORMING A TRANSPORTABLE CONTAINER FOR BULK GOODS

(75) Inventors: Dave Ours, Marshall, MI (US); Sharon Juntunen, Portage, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 13/466,166

(22) Filed: May 8, 2012

(65) Prior Publication Data

US 2012/0217185 A1 Aug. 30, 2012

Related U.S. Application Data

(62) Division of application No. 12/553,406, filed on Sep. 3, 2009, now Pat. No. 8,191,341.

(60) Provisional application No. 61/093,798, filed on Sep. 3, 2008.

(51) Int. Cl.
*B65B 11/02* (2006.01)
*B65B 11/58* (2006.01)
*B65B 43/58* (2006.01)

(52) U.S. Cl. ..... 53/399; 53/436; 53/441; 53/442; 53/449; 53/459

(58) Field of Classification Search ..... 53/399, 53/436, 441, 442, 449, 459, 469, 526, 528, 53/556, 557, 173, 176, 570, 587, 284.7, 139.1; *B65B 11/58, 43/58, 43/59, 43/62*
See application file for complete search history.

(56) References Cited

U.S. PATENT DOCUMENTS

| | | | | | |
|---|---|---|---|---|---|
| 1,474,625 | A * | 11/1923 | Eckert | 100/211 |
| 1,649,362 | A * | 11/1927 | Nagel | 141/12 |
| 1,730,295 | A * | 10/1929 | Reuther | 141/75 |
| 4,546,598 | A * | 10/1985 | Karpisek | 53/556 |
| 4,553,374 | A * | 11/1985 | Lancaster et al. | 53/465 |
| 5,117,750 | A * | 6/1992 | Mosier, II et al. | 100/45 |
| 5,203,671 | A * | 4/1993 | Cawley et al. | 414/791.6 |
| 5,566,530 | A * | 10/1996 | Johnstone et al. | 53/441 |
| 5,701,722 | A * | 12/1997 | Franklin et al. | 53/399 |
| 6,494,324 | B2 * | 12/2002 | Ours et al. | 206/527 |
| 6,594,970 | B1 * | 7/2003 | Hyne et al. | 53/399 |
| 6,647,701 | B2 * | 11/2003 | Rettich | 53/528 |
| 6,892,768 | B1 * | 5/2005 | Ours et al. | 141/10 |
| 6,918,225 | B2 * | 7/2005 | Ours et al. | 53/139.1 |
| 6,935,385 | B2 * | 8/2005 | Ours et al. | 141/10 |
| 6,945,015 | B2 * | 9/2005 | Ours et al. | 53/442 |
| 7,055,293 | B2 * | 6/2006 | Ours et al. | 53/399 |
| 7,174,924 | B2 * | 2/2007 | Ours et al. | 141/10 |
| 7,284,360 | B2 * | 10/2007 | Cary et al. | 53/449 |

(Continued)

*Primary Examiner* — Stephen F Gerrity
(74) *Attorney, Agent, or Firm* — Dickinson Wright PLLC

(57) ABSTRACT

A transportable container for flowable bulk goods is formed by disposing an outer wrap around a bottom support and a portion of a vertically spaced slip frame former. One of the slip frame former and the bottom support moves vertically relative to other in response to the fill level of the bulk goods. As bulk goods are added to the transportable container, the position of the slip frame former is radially adjusted to modify the shape of the transportable container. As the fill level increases in the transportable container, previously disposed portions of outer wrap are disengaged from the slip frame former to squeeze the filled portions of the transportable container. Additional portions of outer wrap are disposed around a portion of the slip frame former to maintain the transportable container for receiving bulk goods as the previously disposed portions of outer wrap are disengaged.

7 Claims, 6 Drawing Sheets

U.S. PATENT DOCUMENTS

| | | | | |
|---|---|---|---|---|
| 7,536,840 | B2 * | 5/2009 | Ours et al. | 53/449 |
| 7,921,624 | B2 * | 4/2011 | Ours et al. | 53/399 |
| 2003/0038055 | A1 * | 2/2003 | Ours et al. | 206/597 |
| 2003/0057129 | A1 * | 3/2003 | Ours et al. | 206/597 |
| 2004/0026292 | A1 * | 2/2004 | Ours et al. | 206/527 |
| 2005/0126126 | A1 * | 6/2005 | Ours et al. | 53/442 |
| 2006/0185327 | A1 * | 8/2006 | Ours et al. | 53/449 |
| 2009/0223179 | A1 * | 9/2009 | Johnstone | 53/562 |

* cited by examiner

METHOD FOR FORMING A TRANSPORTABLE CONTAINER FOR BULK GOODS

CROSS REFERENCE TO RELATED APPLICATION

This application is a divisional of U.S. application Ser. No. 12/553,406 for TRANSPORTABLE CONTAINER FOR BULK GOODS AND METHOD FOR FORMING THE SAME, filed Sep. 3, 2009 now U.S. Pat. No. 8,191,341, which claims the benefit of U.S. Provisional Patent Application Ser. No. 61/093,798 for TRANSPORTABLE CONTAINER FOR BULK GOODS AND METHOD FOR FORMING THE SAME, filed on Sep. 3, 2008, which are hereby incorporated by reference in their entirety.

BACKGROUND OF THE INVENTION

1. Field of the Invention

The subject invention relates to a transportable container of flowable bulk goods and more particularly a method of filling and forming a transportable container of flowable bulk goods.

2. Description of the Prior Art

Typical containers utilized for transport of bulk goods are inefficient, do not have a very large volume, and often require a large amount of manual labor to be used in filling and handling of the container. Also these containers are typically stacked on top of each other during handling and transport, because the containers are not stabilized, this results in damage to the material. It is known in the art of stretch wrapping to stack loads onto a pallet and then shrink wrap the load placed upon the pallet to secure it.

An example of one such system is shown in U.S. Pat. No. 6,594,970 to Hyne et al. The Hyne patent discloses a method and apparatus for wrapping an outer wrap around a stack of products on a bottom support. The system uses a guide which acts as a barrier between the stack of product and the outer wrap. To begin the bottom support is placed at a location adjacent the guide and layers of product are added to the pallet to form the stack. As the layers of products are added to the pallet, the pallet begins to move downwardly from the guide to allow for the outer wrap to be applied to the product to secure and stabilize it. The outer wrap is applied to the guide prior to being received by the layers of products so that the layers of products are not crushed or displaced by the outer wrap.

Another example of one such system is shown in U.S. Pat. No. 4,607,476 to Fulton Jr. The Fulton patent discloses a system for applying an outer wrap to unstable stacks of product on a pallet. The system includes a confinement container having a bottom support or pallet placed on a lift. Layers of unstable product are placed on the pallet to form a stack within the confinement container. A top cap is placed on the top of the unstable layers and the outer wrap is initially applied around the top cap and the upper edge of the confinement container. The lift moves the pallet of unstable products upward and the outer wrap slides off the edge of the confinement container to contact the layers of product for stabilizing the stacks of product.

SUMMARY OF THE INVENTION AND ADVANTAGES

A method of producing a transportable container for flowable bulk goods begins by vertically spacing a slip frame former from a bottom support. A first portion of outer wrap is disposed around the bottom support and a portion of at least one former wall to initially form the transportable container. The transportable container is initially formed prior to the addition of a plurality of bulk goods into the transportable container. The plurality of bulk goods are then fed into the transportable container through a frame opening defined by the slip frame former to establish a fill level. At least one of the slip frame former and the bottom support moves vertically relative to other of the slip frame former and the bottom support in response to the fill level of the bulk goods as determined by a fill sensor. During filling, the slip frame former is maintained at a position to surround the fill level of the bulk goods in the transportable container. As the fill level increases in the transportable container, previously disposed portions of outer wrap are disengaged from the slip frame former to squeeze the filled portions of the transportable container and lock together the bulk goods disposed in the transportable container. Additional portions of outer wrap are disposed around a portion of the at least one wall of the slip frame former to maintain the transportable container for receiving bulk goods as the previously disposed portions of stretch wrap are disengaged from the at least one wall of the slip frame former.

The method forms a transportable container for flowable bulk goods having a bottom support and stretch wrap spirally wrapped around the bottom support and extending vertically from the bottom support to form the transportable container. The transportable container includes a plurality of flowable bulk goods that are disposed within the stretch wrap. The stretch wrap contacts at least a portion of the plurality of bulk goods to squeeze and lock together the plurality of bulk goods disposed in the transportable container. No bag is needed between the bulk goods and the outer wrap.

In an alternative embodiment, the former walls of the slip frame former may move radially inward and outward as the slip frame former moves relative to the transporter base. The radial movement of the former walls of the slip frame former may be controlled by hydraulic pistons, pneumatic pistons, or a geared mechanism. This would allow for modifying the shape of the transportable container to shapes such as, tapered, hour glass, and pumpkin shaped.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
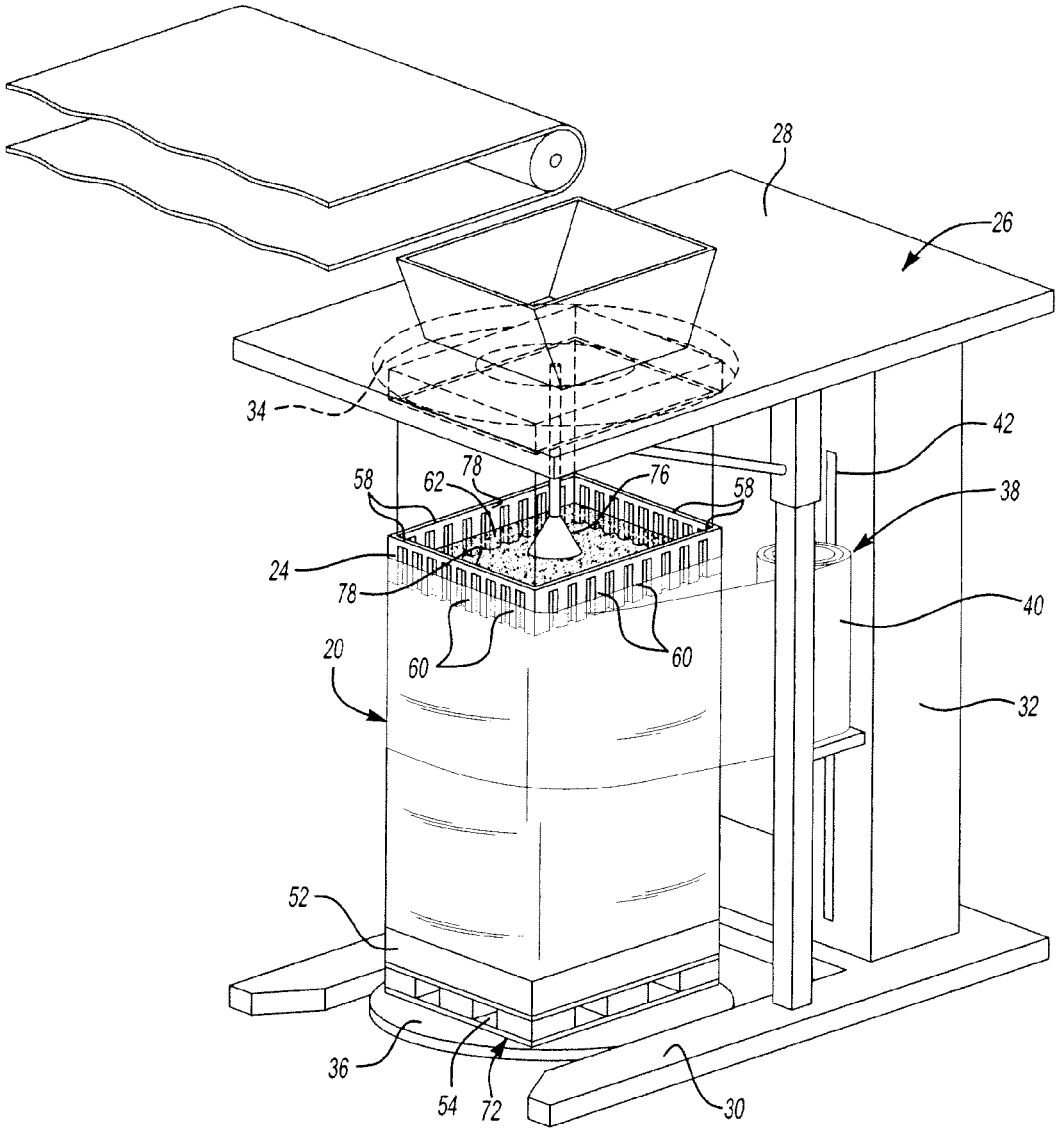
FIG. 1 is perspective view of a first exemplary embodiment of a transportable container formed from a packaging system according to the subject invention.
Figure 2:
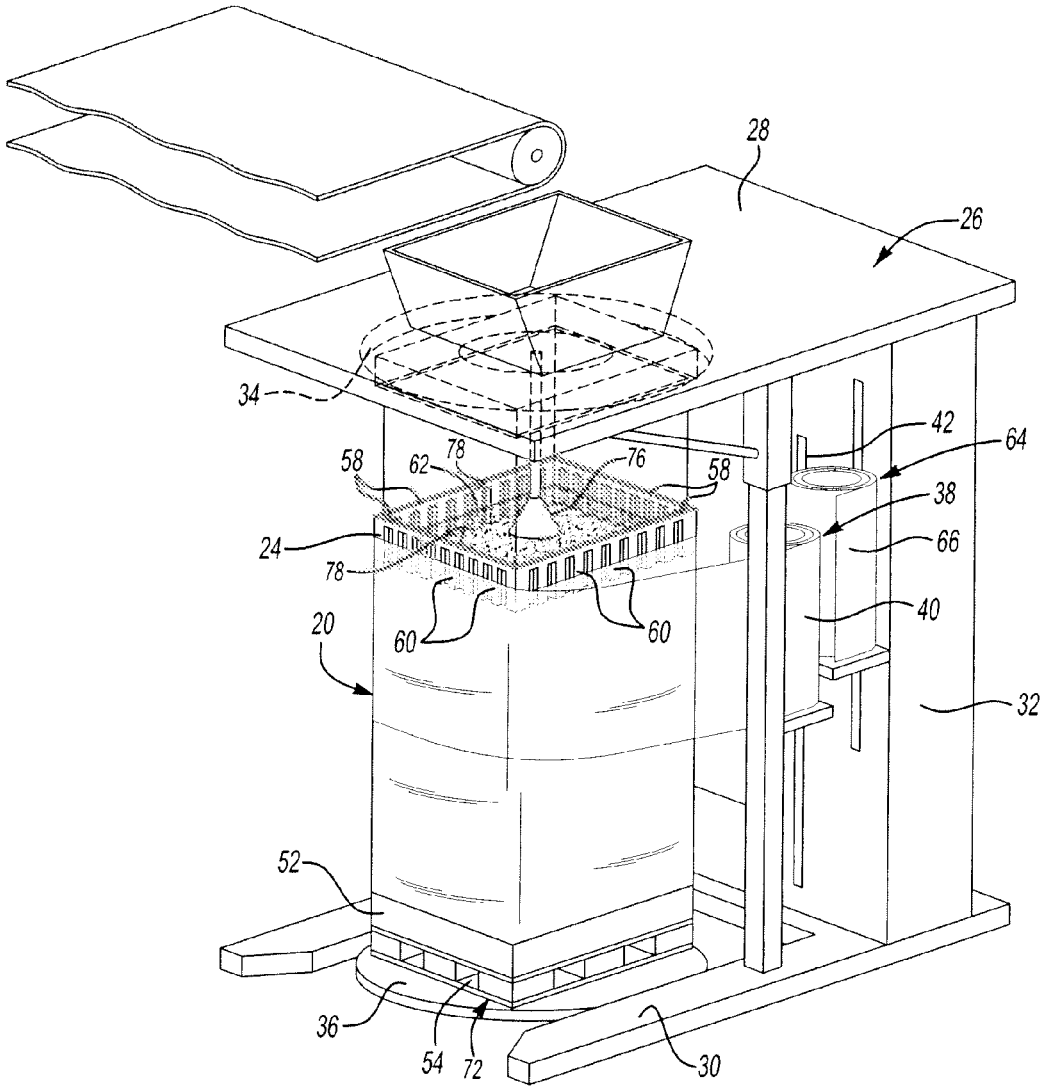
FIG. 2 is perspective view of a second exemplary embodiment of a transportable container formed from a packaging system according to the subject invention.

Referring to the Figures, wherein like numerals indicate corresponding parts throughout the several views, a transportable container 20 of bulk goods and a method of making the same are generally shown.

Throughout the present specification and claims the phrase "bulk goods" is used as a shorthand version of the wide range of products that can be packaged utilizing the present invention. The present invention finds utilization in packaging any material that can be bulk packaged. These items can encompass large bulk packaged pieces as well as very small bulk packaged pieces. Examples of smaller bulk goods include, but are not limited to, the following: agricultural products like seeds, rice, grains, vegetables, fruits, chemical products like fine chemicals, pharmaceuticals, raw chemicals, fertilizers, plastics like plastic resin pellets, plastic parts, rejected plastic parts, machined plastic parts, cereals and cereal products such as wheat, a variety of machined parts of all sorts, wood products like wood chips, landscaping material, peat moss, dirt, sand, gravel, rocks and cement. The present invention also finds utilization in bulk packaging of larger bulk goods including, but not limited to: prepared foods, partially processed foods like frozen fish, frozen chicken, other frozen meats and meat products, manufactured items like textiles, clothing, footwear, toys like plastic toys, plastic half parts, metallic parts, soft toys, stuffed animals, and other toys and toy products. All of these types of materials and similar bulk packaged materials are intended to be encompassed in the present specification and claims by this phrase.

While the present invention may be adapted to work with any number of packaging systems 26, the exemplary embodiment of the present invention will be explained in reference to the exemplary packaging system 26 discussed below.

In the exemplary embodiment, the packaging system 26 includes a frame having an upper support 28 spaced from a frame base 30. At least one support column 32 extends between the frame base 30 and upper support 28. The upper support 28, the frame base 30, or both may be vertically movable along the support column 32.

The packaging system 26 may include an upper turntable 34 that is mounted within the upper support 28 of the packaging system 26 and a lower turntable 36 that is mounted within the frame base 30 of the packaging system 26. The lower turntable 36 and upper turntable 34 may be stationary or rotatable. When the upper turntable 34 and lower turntable 36 are rotatable, it is preferred that the rotation of the lower turntable 36 and upper turntable 34 are synchronized such that they rotate in unison. The synchronized rotation of the of the upper and lower turntables 34, 36 allow for the even distribution of bulk goods in the transportable container 20.

The packaging system 26 comprises a conventional stretch wrapping device 38 such as, for example, a Lantech Q series semi-automatic wrapper. The stretch wrapping device 38 further includes a wrap head having a roll of outer wrap secured on a wrap head base. In the preferred embodiment, the outer wrap is a stretch wrap 40 having a high cling factor and a width between 10 and 30 inches, but the stretch wrap 40 may be any of a variety of stretch wrap 40 films known in the art. The stretch wrap 40 may have a high coefficient of friction, which may lead to delaminating problems. Delaminating may be reduced by applying a glue between layers of stretch wrap 40, welding the stretch wrap 40 layers or any other method of reducing delaminating known in the art. Welding the stretch wrap 40 may include, but is not limited to, heat or sonic welding.

When the upper turntable 34 and lower turntable 36 are rotatable, the wrap head is vertically moveable along a guide rod 42 that runs parallel to the support column 32, and is moved up and down the guide rod 42 by a motor. As the transportable container 20 rotates between the upper turntable 34 and lower turntable 36, stretch wrap 40 is pulled from the wrap head to create the transportable container 20. When the upper turntable 34 and lower turntable 36 are stationary the wrap head is rotatable about the stationary transportable container 20 in addition to being vertically moveable along the guide rod 42 to apply the stretch wrap 40 and create the transportable container 20.

The stretch wrap 40 generates hoop forces which apply a gentle squeeze to the bulk goods, helping to stabilize the bulk goods. The hoop forces stabilize the bulk goods by promoting controllable contact between the elements of the bulk goods being loaded into the transportable container 20 of the transportable container 20, thereby promoting bridging between the components of the bulk goods. For example, when the bulk goods being loaded are a bulk cereal in puff or flake form, hoop forces promote bridging between cereal pieces, thereby reducing the relative motion between the pieces and immobilizing the cereal within the transportable container 20. By adjusting the extent to which the outer wrap is applied to the transportable container 20, hoop forces can be tailored to the type of bulk goods being inserted in the transportable container 20. Hoop forces allow for a very compact and rigid transportable container 20, which does not allow the bulk goods to shift or get crushed within the transportable container 20.

The transportable container 20 includes a bottom support 72 that is placed on the frame base 30. The bottom support 72 includes, but is not limited to a transporter base 22, slip sheet 52, pallet 54 or any other bottom support 72 known in the art. The slip sheet 52 is typically a folded sheet of cardboard, but may be any other material known in the art, including but not limited to plastic. The pallet 54 may be wood, plastic or any other material known in the art. Typically, the pallet 54 and the slip sheet 52 are used together.

Figure 3:
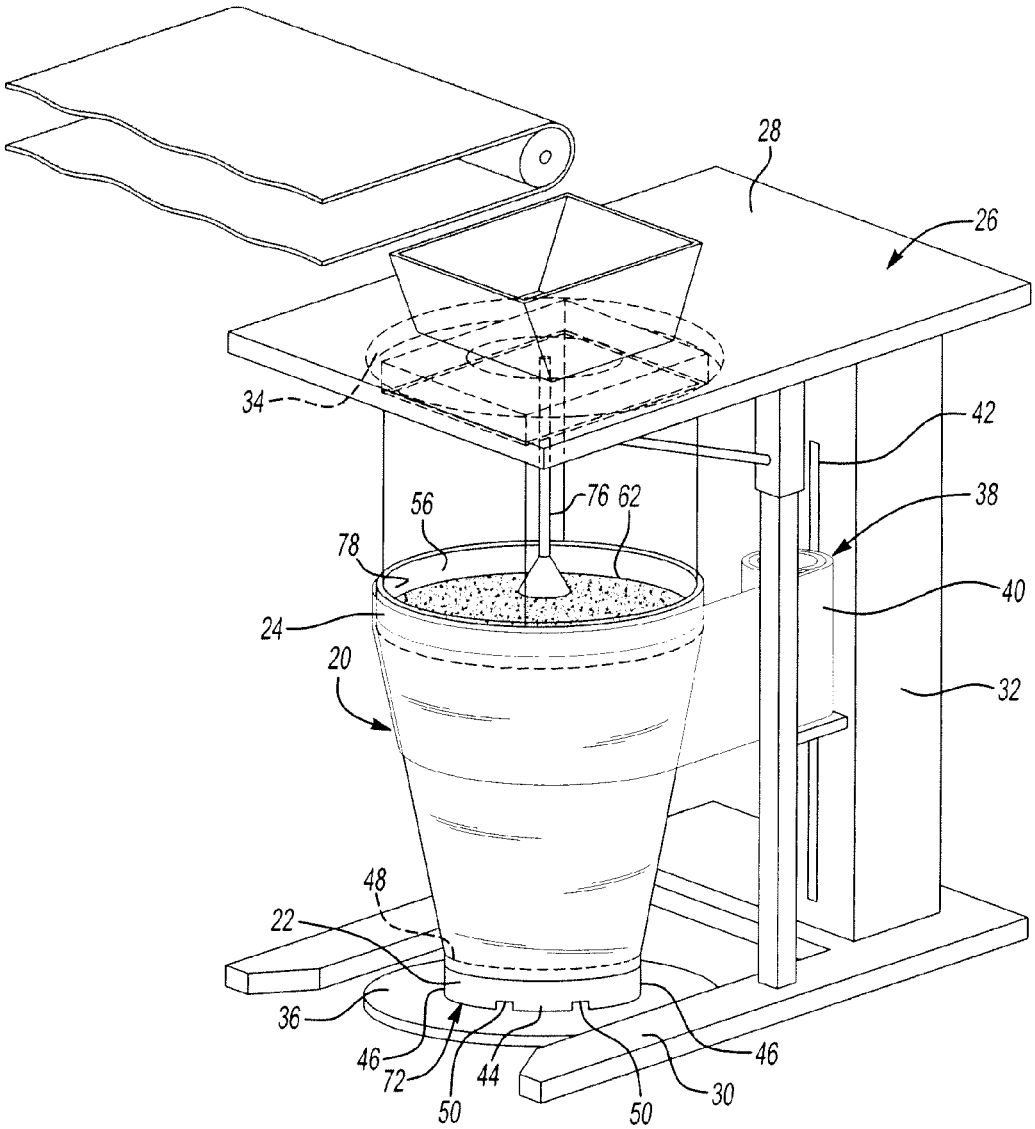
FIG. 3 is perspective view of a third exemplary embodiment of a transportable container formed from a packaging system according to the subject invention.
Figure 4:
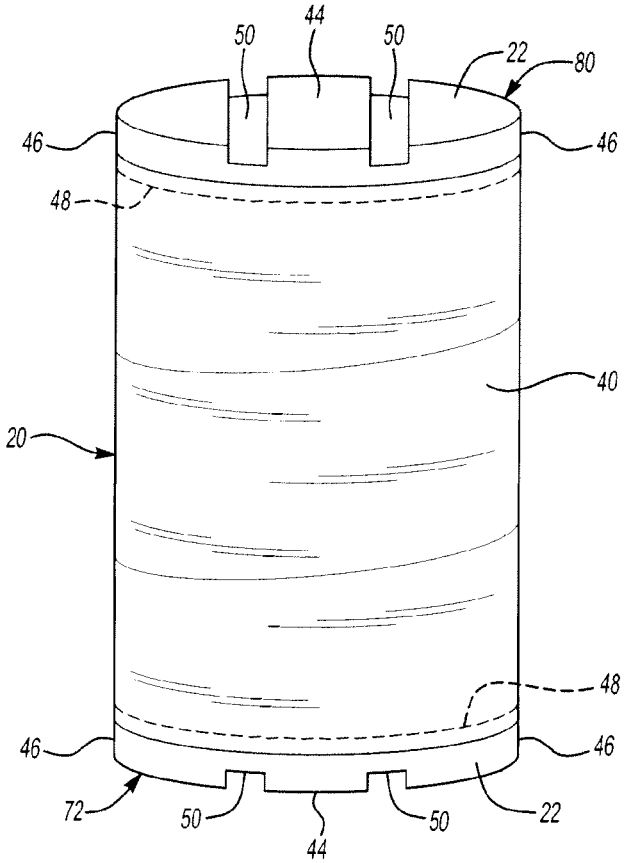
FIG. 4 is perspective view of a first exemplary transportable container being circular in cross section and formed according to the subject invention.

In the preferred embodiment, a transporter base 22 is used and begins the initial forming of the transportable container 20. The transporter base 22 is made of molded plastic, but may be manufactured by any process known in the art and made of any other material known in the art. In an exemplary embodiment, as shown in FIGS. 3 and 4, the transporter base 22 is round, but the transporter base 22 may be square or any other shape known in the art. A round transporter base 22 is utilized to produce a round transportable container 20 while a square transporter base 22 is utilized to produce a square transportable container 20. The square transporter base 22, which results in a square transportable container 20, is the preferred shape. The square transportable container 20 allows for the greatest amount of space to be utilized when a plurality of transportable containers 20 are placed next to one another in a shipping truck. The round transporter base 22, which results in a round transportable container 20, will lead to a void or wasted space being present when the round transportable containers 20 are placed next to one another in a shipping truck.

The transporter base 22 initially forms the bulk goods or particulates disposed in the transportable container 20 and further allows for the transportation of the transportable container 20. The transporter base 22 includes a bottom 44 and a wall 46 extending peripherally from the bottom 44 to a wall end 48. A plurality of ears extend radially outward from the wall end 48. In the exemplary embodiment, the bottom 44 of the round transporter base 22 has a diameter of 48 inches and the wall 46 has a height of 8 inches. These dimensions are the preferred dimensions, but the base diameter and wall 46 height may be adjusted. The wall 46 assists in the initial shaping of the transportable container 20.

The transporter base 22 includes at least one pair of recesses 50 that extend upwardly from the bottom 44 of the transporter base 22 so that the tines of a transporting device can pickup and move the transportable container 20 of bulks goods. The transporter base 22 may further include a plurality of inwardly extending notches so the bulk goods will not conform directly to the inner surface of the transporter base 22, which may be problematic in removing the bulk goods from the transporter base 22.

The subject invention includes a slip frame former 24 to shape and form the transportable container 20. The slip frame former 24 may be round, square or any other shape known in the art. The shape of the slip frame former 24 is chosen based on the desired shape of the transportable container 20. The shape of the transportable container 20 is determined by the shape of the slip frame former 24. For example, a round slip frame former 24 will produce a round transportable container 20 while a square slip frame former 24 will produce a square transportable container 20.

In the exemplary embodiment, the slip frame former 24 includes at least one former wall 56 having an outer surface that defines a frame opening 78. The former walls 56 are from about 6 to 15 inches in height and may be made from metal, plastic, or any other material known in the art. The former walls 56 are configured such that the frame opening 78 is the desired shape in which the transportable container 20 will be formed into. For example, when a square shaped transportable base is desired, the slip frame former 24 includes former walls 56 that are secured to one another to define the square shaped frame opening 78. When a circular shaped transportable base is desired, the slip frame former 24 includes a continuous former wall 56 that is shaped to define a circular shaped frame opening 78. In the exemplary embodiment, the former walls 56 have a continuous outer surface that extends from the bottom 44 of the slip frame former 24 to the top of the slip frame former 24. When the slip frame former 24 is used in addition to the transporter base 22, the slip frame former 24 will typically be the same shape as the transporter base 22 so as to hold the desired shape of the transporter base 22. The slip frame former 24 may be a solid shape having former walls 56 or consist of a former base 58 having former arms 60 extending downwardly from the former base 58.

The method of producing a transportable container 20 for flowable bulk goods begins by vertically spacing a slip frame former 24 from a bottom support 72. A first portion of outer wrap is disposed around the bottom support 72 and a portion of the at least one former wall 56 to initially form the transportable container 20. The transportable container 20 is initially formed prior to the addition of the plurality of bulk goods into the transportable container 20. The plurality of bulk goods are then fed into the transportable container 20 through a frame opening 78 defined by the slip frame former 24 to establish a fill level 62. At least one of the slip frame former 24 and the bottom support 72 moves vertically relative to other of the slip frame former 24 and the bottom support 72 in response to the fill level 62 of the bulk goods as determined by the fill sensor 76. During filling, the slip frame former 24 is maintained at a position to surround the fill level 62 of the bulk goods in the transportable container 20. As the fill level 62 increases in the transportable container 20, previously disposed portions of outer wrap are disengaged from the slip frame former 24 to squeeze the filled portions of the transportable container 20 and lock together the bulk goods disposed in the transportable container 20. Additional portions of outer wrap are disposed around a portion of the at least one wall 46 of the slip frame former 24 to maintain the transportable container 20 for receiving bulk goods as the previously disposed portions of stretch wrap 40 are disengaged from the at least one wall 46 of the slip frame former 24.

In the exemplary embodiment, the outer wrap is a stretch wrap 40 that is disposed from a wrap head. The stretch wrap 40 is disposed spirally about the bottom support 72 and a portion of the at least one former wall 56 of the slip frame former 24 to initially form the transportable container 20. Additional portions of stretch wrap 40 are spirally disposed about a portion of the at least one wall 46 of the slip frame former 24 to maintain the transportable container 20 for receiving bulk goods as previously disposed portions of outer wrap disengage the at least one wall 46 of the slip frame former 24.

In an exemplary embodiment, the slip frame former 24 is moved vertically upwardly relative to the stationary bottom support 72 in response to the fill level 62 of the bulk goods in the transportable container 20. The slip frame former 24 is maintained in a position to surround the fill level 62 of the bulk goods in the transportable container 20. The slip frame former 24 is secured to the upper support 28. With the slip frame former 24 in a lowered position, the stretch wrap 40 from the stretch wrapping device 38 is wrapped around the bottom support 72 and the slip frame former 24 to initially form the transportable container 20. The slip frame former 24 moves upwardly with upper support 28 as a fill level 62 of bulk goods moves upwardly during filling of the transportable container 20. The slip frame former 24 moves relative to the bottom support 72 to disengage the previously disposed portions of the stretch wrap 40 from the slip frame former 24 as the level of bulk goods rises in the transportable container 20. The system can be adjusted to provide overlapping layers of outer wrap spaced apart from 0.5 to 15 inches. The stretch wrap 40 that is used to secure the transportable container 20 overlaps the slip frame former 24 so as to maintain the shape of the slip frame former 24. The slip frame former 24 may include a Teflon coating or dimpled surface, particularly on the corners of the former walls 56 or the downwardly extending former arms 60. The Teflon coating allows for the slip frame former 24 to be easily pulled away from the stretch wrap 40 as the slip frame former 24 moves in response the level of bulk goods.

In an alternative embodiment, the bottom support 72 is moved vertically downwardly relative to the stationary slip frame former 24 in response to the fill level 62 of the bulk goods in the transportable container 20. The slip frame former 24 is maintained in a position to surround the fill level 62 of the bulk goods in the transportable container 20. The lower turntable 36 and frame base 30 may vertically movable. With the slip frame former 24 in a lowered position, the stretch wrap 40 from the stretch wrapping device 38 is wrapped around the bottom support 72 and the slip frame former 24 to initially form the transportable container 20. As the transportable container 20 disposed on the frame base 30 is filled, the frame base 30 is moved in a downward direction to accommodate additional bulk goods in the transportable container 20. Movement of the lower turntable 36 can be accomplished by any of a variety of mechanisms including scissors platform legs, hydraulic pistons, pneumatic pistons, or a geared mechanism. The slip frame former 24 moves relative to the bottom support 72 to disengage the previously disposed portions of the stretch wrap 40 from the slip frame former 24 as the level of bulk goods rises in the transportable container 20. Again, the slip frame former 24 may include a Teflon coating to allow the stretch wrap 40 to be easily pulled away from the slip frame former 24 as the frame base 30 and stretch wrapping device 38 move downwardly from the slip frame former 24.

The method forms a transportable container 20 for flowable bulk goods having a bottom support 72 and stretch wrap 40 spirally wrapped around the bottom support 72 The stretch wrap 40 extends vertically from the bottom support 72 to form the transportable container 20. The transportable container 20 includes a plurality of flowable bulk goods that are disposed within the stretch wrap 40. The stretch wrap 40 contacts at least a portion of the plurality of bulk goods to squeeze and lock together the plurality of bulk goods disposed in the transportable container 20. No bag 68 is needed between the bulk goods and outer wrap.

Figure 6:
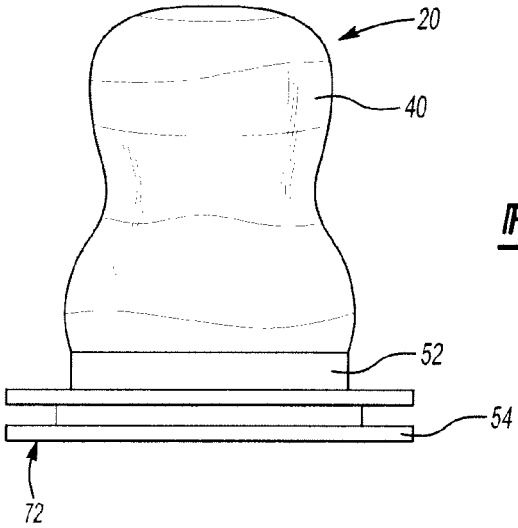
FIG. 6 is front view of a third exemplary transportable container being hour glass shaped and formed according to the subject invention.
Figure 7:
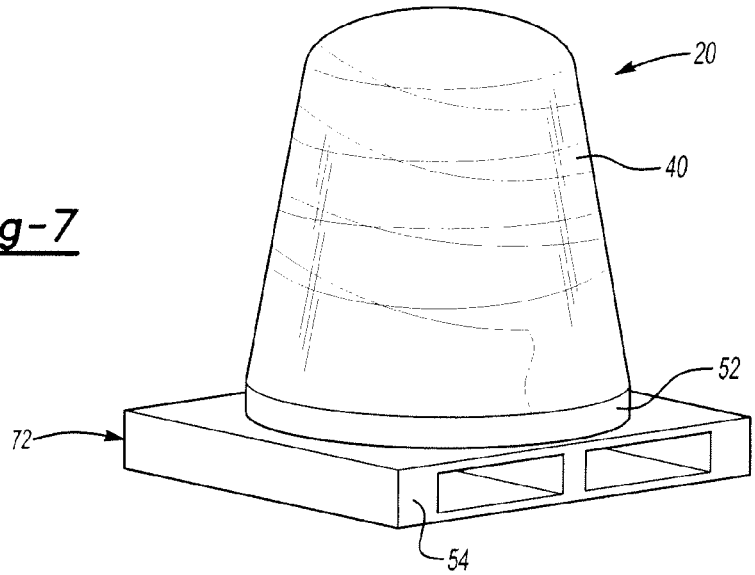
FIG. 7 is perspective view of a fourth exemplary transportable container being tapered and formed according to the subject invention.
Figure 8:
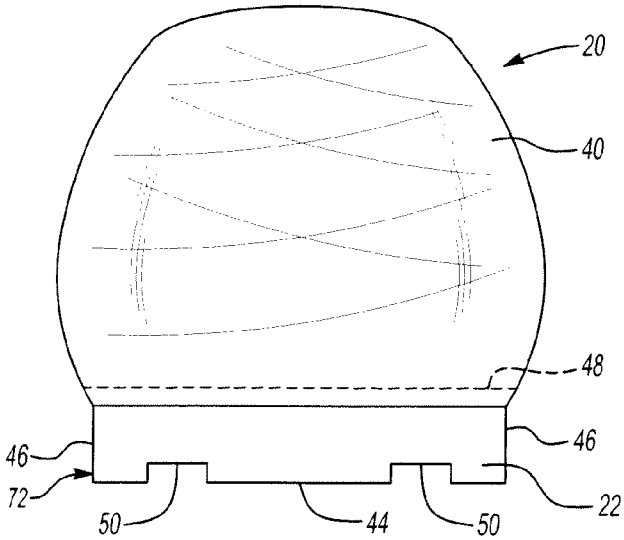
FIG. 8 is perspective view of a fifth exemplary transportable container being pumpkin shaped and formed according to the subject invention.

In an alternative embodiment as seen in FIG. 3, the former walls 56 of the slip frame former 24 may move radially inward and outward as the slip frame former 24 moves upwardly with upper support 28. The radial position of the at least one former wall 56 is adjusted radially to modify the shape of the transportable container 20. The radial movement of the former walls 56 of the slip frame former 24 may be controlled by hydraulic pistons, pneumatic pistons, a geared mechanism or any other method known in the art. In the exemplary embodiment, slip frame former 24 is segmented or made of fingers or rods. Each segment is movable independently or on a linkage such that when a command is received to move the slip frame former 24 radially inward or outward, the segments move in two directions, thus enabling the sides to move closer together or farther apart. This motion is controlled based on the particular shape desired. The radial movement of the slip frame former 24 results in the transportable container 20 having a shape that varies radially in vertical relationship to the bottom support 72. For example, the shape of the transportable container 20 could be hour glass shaped as shown in FIG. 6, tapered as shown in FIG. 7, pumpkin shaped as shown in FIG. 8 or any other desired shape known in the art. In addition, the radial movement of the slip frame former 24, as the fill level 62 of bulk goods rises, provides the benefit of increasing the effective hoop force on the bulk goods that are more difficult to lock up, resulting in a transportable container 20 having a corrugated shape in vertical relationship to the bottom support 72.

Figure 9:
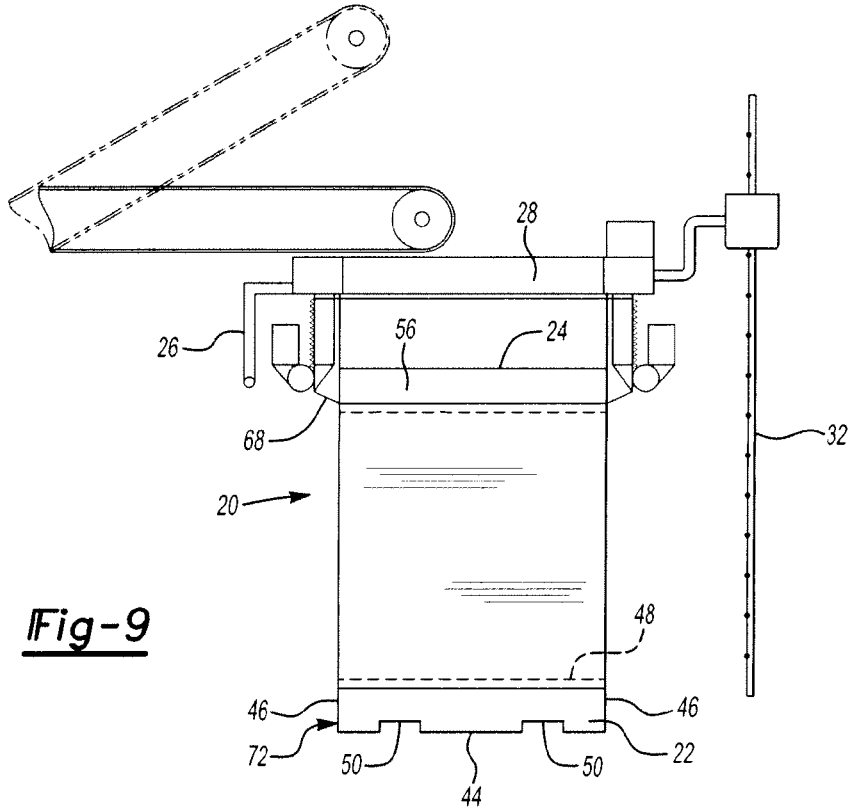
FIG. 9 is side view of a fourth exemplary embodiment of a transportable container formed from a packaging system according to the subject invention.

In an alternative embodiment as shown in FIG. 9, the outer wrap is a stretch tube or stretch bag 68. The stretch bag 68 may be used in place of the stretch wrapping device 38 to form the transportable container 20. A predetermined length of the stretch bag 68 is released with respect to the transportable container 20. During the filling process, the predetermined length of the stretch bag 68 can be selected based on the filling rate. For example, a greater length of the stretch bag 68 can be released in response to a high fill rate. Alternatively, the length can be selected based on the density of the material. For example, a greater length of the stretch bag 68 can be released in response to a higher density fill material. The stretch bag 68 can be incrementally released from the bunched orientation or continuously released.

The slip frame former 24 is initially disposed adjacent the bottom support 72. A first portion of the radially flexible stretch bag 68 is disposed around the bottom support 72 and a portion of the slip frame former 24 to initially form the transportable container 20.

The transportable container 20 is then filled with a plurality of bulk goods through an opening in the stretch bag 68. The opening of the radially flexible stretch bag 68 is reduced to a smaller fill diameter substantially at the slip frame former 24 as the fill level 62 rises during filling of the transportable container 20. As discussed above, the slip frame former 24 may include a Teflon coating or dimpled surface, particularly on the corners of the former walls 56 or the downwardly extending arms. The Teflon coating allows for the slip frame former 24 to be easily pulled away from the stretch bag 68 as the slip frame former 24 moves upwardly in response the level of bulk goods. The large diameter is reduced by radially stretching the stretch bag 68 prior to filling and, after filling substantially to the fill level 62, releasing a stretched portion of the transportable container 20 substantially adjacent the slip frame former 24. In other words, the transportable container 20 can be expanded to define the opening for receiving bulk goods. The packaging system 26 can include a stretching device to radially stretch the stretch bag 68 prior to filling. The stretch bag 68 may be formed from any food grade material, such as for example, low density polyethylene, high density polyethylene, a food grade polymer, or nylon.

The slip frame former 24 moves relative to the bottom support 72 to disengage the previously disposed portions of the stretch bag 68 from the slip frame former 24 as the level of bulk goods rises in the transportable container 20. Additional portions of the stretch bag 68 are disposed around a portion of the slip frame former 24 to maintain the transportable container 20 for receiving bulk goods as previously disposed portions of the stretch bag 68 disengage the slip frame former 24.

The reduction of the stretch bag 68 at the slip frame former 24 by releasing a stretched portion of the stretch bag 68 at the fill level 62 generates hoop forces which apply a gentle squeeze to the bulk goods, helping to support and firm it. The hoop forces stabilize the bulk goods by promoting controllable contact between the elements of the bulk goods being loaded into the stretch bag 68, thereby promoting bridging between the components of the bulk goods. For example, when the bulk goods being loaded are a bulk cereal in puff or flake form, hoop forces promote bridging between cereal pieces, thereby reducing the relative motion between the pieces and immobilizing the cereal within the stretch bag 68. By adjusting the extent of shrinkage, hoop forces can be tailored to the type of bulk goods being inserted in the transportable container 20. Hoop forces allow for a very compact and rigid transportable container 20, which does not allow the bulk goods to shift or get crushed within the transportable container 20.

Figure 10:
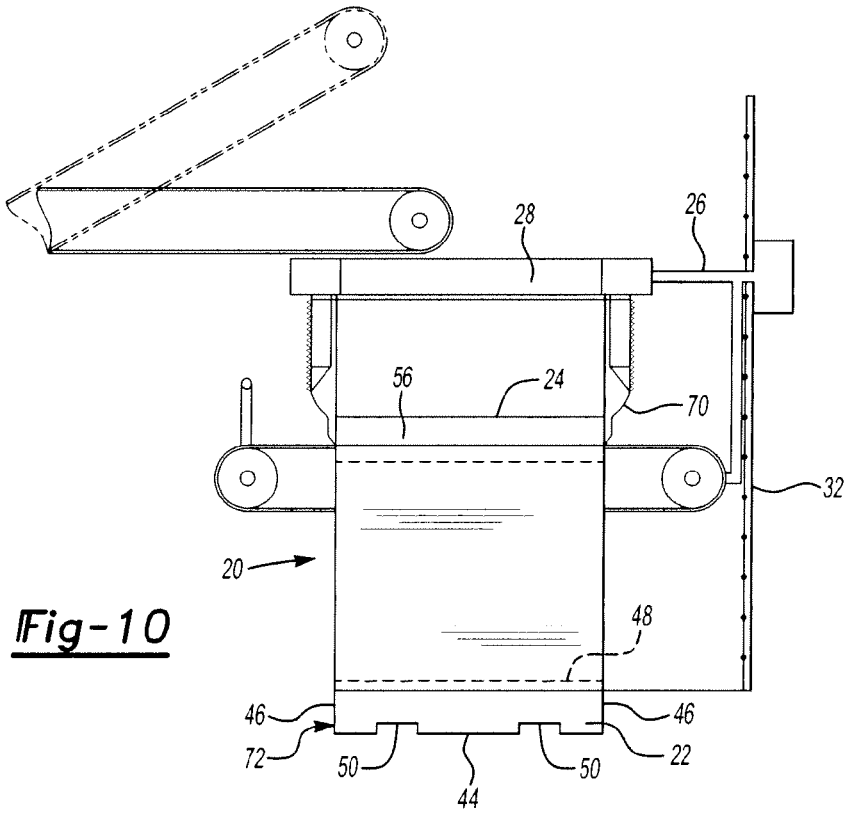
FIG. 10 is side view of a fifth exemplary embodiment of a transportable container formed from a packaging system according to the subject invention.

In an alternative embodiment as shown in FIG. 10, the outer wrap is a heat shrink film 70. The heat shrink film 70 may be used in place of the stretch wrapping device 38 or stretch bag 68 to initially form the transportable container 20. The slip frame former 24 is disposed adjacent the bottom support 72. A first portion of the heat shrink film 70 is disposed around the bottom support 72 and a portion of the slip frame former 24 to initially form a transportable container 20.

The transportable container 20 is filled with a plurality of bulk goods through an opening in the heat shrink film 70. The opening of the radially flexible heat shrink film 70 is reduced to a smaller fill diameter substantially at the slip frame former 24 as the fill level 62 rises during filling of the flexible heat shrink film 70. As discussed above, the slip frame former 24 may include a Teflon coating or dimpled surface, particularly on the corners of the former walls 56 or the downwardly extending arms. The Teflon coating allows for the slip frame former 24 to be easily pulled away from the heat shrink film 70 as the slip frame former 24 moves upwardly in response the level of bulk goods. The large diameter is reduced by shrinking the heat shrink film 70 prior to filling and, after filling substantially to the fill level 62, shrinking a portion of the heat shrink film 70 substantially adjacent the slip frame former 24. In other words, the transportable container 20 can be expanded to define the opening for receiving bulk goods. The packaging system 26 provided by the invention includes a shrinking device to shrink the large diameter. The shrinking device can include a heater to direct heat at transportable container 20 adjacent the slip frame former 24 to shrink the large diameter to the fill diameter. Preferably, the shrinking device is kept within plus or minus twelve inches of the fill level 62.

The slip frame former 24 moves relative to the bottom support 72 to disengage the previously disposed portions of the heat shrink film 70 from the slip frame former 24 as the level of bulk goods rises in the transportable container 20. Additional portions of the heat shrink film 70 are disposed around a portion of the slip frame former 24 to maintain the transportable container 20 for receiving bulk goods as previously disposed portions of the heat shrink film 70 disengage the slip frame former 24.

The reduction of the heat shrink film 70 at the slip frame former 24 by shrinking the heat shrink film 70 to form the transportable container 20 at the fill level 62 generates hoop forces which apply a gentle squeeze to the bulk goods, helping to support and firm it. The hoop forces stabilize the bulk goods by promoting controllable contact between the elements of the bulk goods being loaded into transportable container 20, thereby promoting bridging between the components of the bulk goods. For example, when the bulk goods being loaded are a bulk cereal in puff or flake form, hoop forces promote bridging between cereal pieces, thereby reducing the relative motion between the pieces and immobilizing the cereal within the transportable container 20. By adjusting the extent of shrinkage, hoop forces can be tailored to the type of bulk goods being inserted in the transportable container 20. Hoop forces allow for a very compact and rigid container, which does not allow the bulk goods to shift or get crushed within the transportable container 20.

The transportable container 20 can be closed or left open depending on bulk goods. For example, certain bulk goods such as wood chips, sand, gravel, and other bulk goods, may not require that transportable container 20 be closed. In such instances, the stretch wrap 40 stretch bag 68 or heat shrink film 70 would be applied around the bulk goods in an upward direction to secure bulk goods and create the transportable container 20. Alternatively, the transportable container 20 may be closed in any of a variety of manners known in the art including, but not limited to: sonic or heat welding of the top of the transportable container 20, closure of the top of the transportable container 20 with a plastic pull tie, closure of the top of the transportable container 20 with wire or rope, closure of the top of the transportable container 20 with a clamp, and other closure means known in the art.

The subject invention may further include a second stretch wrapping device 64 for closing the transportable container 20. The second stretch wrapping device 64 includes a wrap head having a roll of secondary wrap 66 secured on a wrap head base. The secondary wrap 66 is preferably a heat sealable polyethylene or other flexible poly or plastic film, but the secondary wrap 66 may be any of a variety of secondary wrap 66 films known in the art. When the fill level 62 has reached it desired level, the slip frame former 24 is pulled away from the transportable container 20 and the secondary wrap 66 is applied to transportable container 20. The secondary wrap 66 extends upwardly from the transportable container 20 and can be used to create a top flap. The top flap is folded over and stretch wrap 40 is applied over the folded top flap to seal the transportable container 20. In addition, the secondary wrap 66 may be welded or heat sealed. A heater (not shown) can be used to direct heat at excess material of secondary wrap 66 at the top of the transportable container 20 to seal the transportable container 20. Additionally, a heater can be used to direct heat at excess material of stretch wrap 40, secondary wrap 66, stretch bag 68 or heat shrink film 70 at the top of the transportable container 20 to seal the transportable container 20.

Figure 5:
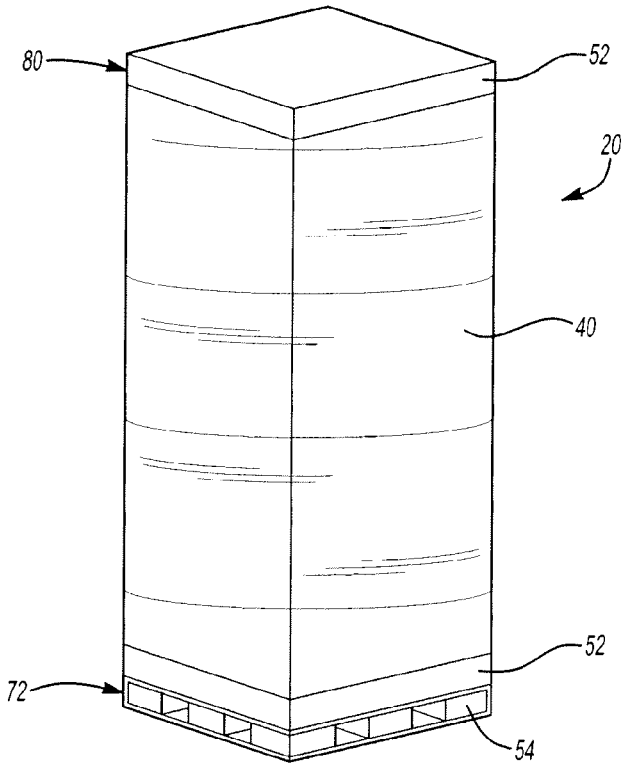
FIG. 5 is perspective view of a second exemplary transportable container being square in cross section and formed according to the subject invention.

Further, the transportable container 20 may be closed by placing a top support 80 upon the filled transportable container 20. The top support 80 is vertically spaced from the bottom support 72 and wrapped within the stretch wrap 40 to form a cover or top for the transportable container 20. The top support 80 may be a transporter base 22 as seen in FIG. 4, a slip sheet 52 as seen in FIG. 5, or a flat sheet of cardboard or plastic on the top of the transportable container 20. After placement of the transporter base 22, slip sheet 52 or flat sheet on the top of the transportable container 20, the transportable container 20 is wrapped with additional stretch wrap 40 to secure the transporter base 22, slip sheet 52 or flat sheet on the top of the transportable container 20.

The system preferably includes a control panel to permit an operator to control various functions such as stop, start, rotation speed and wrap head movement speed. Such controls are known in the art. The system further includes controls to maintain proper fill level 62, outer wrap force and sequencing. The relationship of these parameters is constantly monitored and automatically adjusted by means known in the art.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of producing a transportable container for flowable bulk goods comprising the steps of:

vertically spacing a slip frame former having at least one former wall defining a frame opening from a bottom support;

disposing a first portion of outer wrap around the bottom support and a portion of the at least one former wall to initially form a portion of a transportable container prior to the addition of a plurality of bulk goods to the transportable container;

disposing the plurality of bulk goods into the transportable container through the frame opening to establish a fill level;

vertically moving at least one of the slip frame former and the bottom support relative to the other of the slip frame former and the bottom support to maintain the position of the slip frame former relative to the fill level of bulk goods in the transportable container;

radially adjusting the position of the at least one former wall as the at least one of the slip frame former and the bottom support moves relative to the other of the slip frame former and the bottom support to modify the shape of the transportable container;

disengaging previously disposed portions of outer wrap from the slip frame former to squeeze the filled portions of the transportable container and lock together the bulk goods disposed in the transportable container as the at least one of the slip frame former and the bottom support moves relative to the other of the slip frame former and the bottom support; and disposing additional portions of outer wrap around a portion of the at least one wall of the slip frame former to maintain the transportable container and continue to form the transportable container for receiving bulk goods as previously disposed portions of outer wrap disengage the at least one wall of the slip frame former.

2. The method as set forth in claim 1 wherein the adjusting step is further defined as radially adjusting the position of the at least one former wall as the at least one of the slip frame former and the bottom support moves relative to the other of the slip frame former and the bottom support to create a transportable container having a tapered shaped.

3. The method as set forth in claim 1 wherein the adjusting step is further defined as radially adjusting the position of the at least one former wall as the at least one of the slip frame former and the bottom support moves relative to the other of the slip frame former and the bottom support to create a transportable container having a hour glass shape.

4. The method as set forth in claim 1 wherein the adjusting step is further defined as radially adjusting the position of the at least one former wall as the at least one of the slip frame former and the bottom support moves relative to the other of the slip frame former and the bottom support to create a transportable container having a pumpkin shape.

5. The method as set forth in claim 1 wherein the disposing the outer wrap step is further defined as applying a stretch wrap from a wrap head spirally about the bottom support and a portion of the at least one former wall of the slip frame former to initially form the transportable container, and wherein the disposing additional portions of outer wrap step is further defined as applying additional portions of the stretch wrap spirally about a portion of the at least one wall of the slip frame former to maintain the transportable container for receiving bulk goods as previously disposed portions of outer wrap disengage the at least one wall of the slip frame former.

6. The method as set forth in claim 1 wherein the disposing the outer wrap step is further defined as applying a stretch bag from a carrier radially about the bottom support and a portion of the at least one former wall of the slip frame former to initially form the transportable container by reducing the stretch bag from a large diameter on the carrier to a smaller fill diameter at the bottom support and slip frame former, and wherein the disposing additional portions of outer wrap step is further defined as applying additional portions of the stretch bag radially about a portion of the at least one former wall of the slip frame former by reducing the stretch bag from the large diameter on the carrier to the smaller fill diameter at the slip frame former to maintain the transportable container for receiving bulk goods as previously disposed portions of the stretch bag disengage the at least one former wall of the slip frame former.

7. The method as set forth in claim 1 wherein the disposing the outer wrap step is further defined as applying a heat shrink film from a carrier radially about the bottom support and a portion of the at least one former wall of the slip frame former to initially form the transportable container by heating the heat shrink film to reduce the heat shrink film from a large diameter on the carrier to a smaller fill diameter at the bottom support and slip frame former, and wherein the disposing additional portions of outer wrap step is further defined as applying additional portions of the heat shrink film radially about a portion of the at least one former wall of the slip frame former by heating the heat shrink film to reduce the heat shrink film from a large diameter on the carrier to a smaller fill diameter at the slip frame former to maintain the transportable container for receiving bulk goods as previously disposed portions of the heat shrink film disengage the at least one former wall of the slip frame former.

* * * * *